US010192511B2

(12) United States Patent
Gong

(10) Patent No.: US 10,192,511 B2
(45) Date of Patent: Jan. 29, 2019

(54) DISPLAY DRIVING CIRCUIT AND PIXEL STRUCTURE

(71) Applicant: WUHAN CHINA STAR OPTOELECTRONICS TECHNOLOGY CO., LTD., Hubei (CN)

(72) Inventor: Qiang Gong, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 211 days.

(21) Appl. No.: 15/325,969

(22) PCT Filed: Oct. 13, 2016

(86) PCT No.: PCT/CN2016/101955

§ 371 (c)(1),
(2) Date: Jan. 12, 2017

(87) PCT Pub. No.: WO2018/040238

PCT Pub. Date: Mar. 8, 2018

(65) Prior Publication Data

US 2018/0218706 A1 Aug. 2, 2018

(30) Foreign Application Priority Data

Aug. 30, 2016 (CN) ..... 2016 1 0768681

(51) Int. Cl.
*G09G 3/36* (2006.01)

(52) U.S. Cl.
CPC ..... *G09G 3/3696* (2013.01); *G09G 3/36* (2013.01); *G09G 3/3685* (2013.01)

(58) Field of Classification Search
None
See application file for complete search history.

(56) References Cited

U.S. PATENT DOCUMENTS

2002/0093472 A1* 7/2002 Numao ..... G09G 3/3258 345/87
2009/0091579 A1* 4/2009 Teranishi ..... G09G 3/3659 345/530

* cited by examiner

*Primary Examiner* — Christopher J Kohlman
(74) *Attorney, Agent, or Firm* — WPAT, PC

(57) ABSTRACT

A display driving circuit and a pixel structure are provided. The driving circuit includes a first latch, a second latch and a logic control unit. The logic control is used for selecting to output one of four preset voltages to a pixel electrode via a voltage output end based upon a first data voltage and a second data voltage input by two logic control ends.

13 Claims, 4 Drawing Sheets

DISPLAY DRIVING CIRCUIT AND PIXEL STRUCTURE

FIELD OF THE INVENTION

The present invention relates to the field of a liquid crystal display, and more particularly to a display driving circuit and a pixel structure.

BACKGROUND OF THE INVENTION

The memory-in-pixel (MIP) is a design that stores display of a grayscale signal control pixel in pixels. Conventional pixel designs rely on storage capacitors (Cst) to maintain a grayscale voltage of pixel display. Even if the same image is displayed, each frame needs to refresh (to recharge the pixels). Pixels adopting MIP design store the grayscale signal controlling pixel display in the pixels. If the grayscale displayed by the pixels is unchanged, there is no need to refresh and no need to rewrite the data signal. Therefore, when a static image is being displayed, the scan lines and data lines do not operate, thereby effectively reducing power consumption of display panels. However, since it is required to dispose the MIP circuits in the pixels, this design is only applicable to total reflection LCD and OLED panels, and not applicable to backlit LCD panels.

Therefore, the prior art has a drawback in urgent need of improvement.

SUMMARY OF THE INVENTION

It is an object of the present invention to provide a display driving circuit and a pixel structure for solving the technical problem that it is needed for a conventional backlit LCD to refresh in the display of each frame, resulting in high power consumption.

A primary object of the present invention is to provide a technical solution as follows:

The present invention provides a display driving circuit, comprising:

a first latch for latching a first data voltage;

a second latch for latching a second data voltage;

a logic control unit having two logic control ends, four voltage input ends and a voltage output end, wherein an output end of the first latch and an output end of the second latch are respectively connected with one of the logic control ends, the four voltage input ends are respectively connected with four different preset voltages, and the logic control unit is used for selecting to output one of the four preset voltages to a pixel electrode via the voltage output end based upon a first data voltage and a second data voltage input by the two logic control ends.

The display driving circuit in the present invention, further comprises:

a first thin film transistor having a source for inputting the first data voltage, a gate for inputting a first scan voltage and a drain connected to an input end of the first latch; and a second thin film transistor having a source for inputting a second data voltage, a gate for inputting a second scan voltage and a drain connected to an input of the second latch.

In the display driving circuit in the present invention, the logic control unit includes a selection module and four third thin film transistors, the selection module has the two logic control ends and four level output ends, input ends of the four third thin film transistors are respectively connected with one of the voltage input ends, output ends of the four third thin film transistors are respectively connected with the voltage output end, and gates of the four third thin film transistors are respectively connected with one of the four level output ends, the selection module selects to switch on one of the four third thin film transistors based upon the first data voltage and the second data voltage, and the other three of the third thin film transistors are switched off.

In the display driving circuit in the present invention, the selection module includes a two-input first NOR gate, a two-input second NOR gate, a two-input third NOR gate, a two-input first NAND gate and a two-input first inverter; a first input end of the first NOR gate, a first input end of the second NOR gate and a first input end of the first NAND gate are respectively connected with an output end of the first latch; a second input end of the first NOR gate, a first input end of the third NOR gate and a second input end of the first NAND gate are respectively connected with an output end of the second latch; a second input end of the second NOR gate and a second input end of the third NOR gate are connected with a output end of the first NOR gate; an input end of the first inverter is connected with an output end of the first NAND; and output ends of the first NOR gate, the second NOR gate, the third NOR gate and the first inverter are respectively connected with the gate of the third thin film transistor.

In the display driving circuit in the present invention, the first NAND gate includes a second N-channel thin film transistor, a third N-channel thin film transistor, a second P-channel thin film transistor, and a third P-channel thin film transistor;

input ends of the second P-channel thin film transistor and the third P-channel thin film transistor are connected, and a first preset voltage is connected to a connection point at which the input ends of the second P-channel thin film transistor and the third P-channel thin film transistor are connected;

output ends of the second N-channel thin film transistor, the second P-channel thin film transistor, and the third P-channel thin film transistor are connected at a connection point which is served as an output end of the first NAND gate;

a gate of the second P-channel thin film transistor and a gate of the second N-channel thin film transistor are connected at a connection point which is served as the first input end of the first NAND gate;

a gate of the third P-channel thin film transistor and a gate of the third N-channel thin film transistor are connected at a connection point which is served as the second input end of the first NAND gate; and an input end of the third N-channel thin film transistor is connected with a second preset voltage.

In the display driving circuit in the present invention, the first latch and the second latch each includes two second inverters which are connected end-to-end.

In the display driving circuit in the present invention, the second inverter includes a first N-channel thin film transistor and a first P-channel thin film transistor, output ends of the first N-channel thin film transistor and the first P-channel thin film transistor are connected at a connection point which is served as an output end of the second inverter, gates of the first N-channel thin film transistor and the first P-channel thin film transistor are connected at a connection point which is served as an input end of the second inverter; and input ends of the first N-channel thin film transistor and the first P-channel thin film transistor are respectively connected with a first preset voltage and a second preset voltage.

The present invention provides a pixel structure comprising a pixel capacitance and a display driving circuit, wherein the pixel capacitance includes a common electrode and a pixel electrode;

the display driving circuit includes:

a first thin film transistor having a source for inputting the first data voltage and a gate for inputting a first scan voltage;

a first latch having an input connected to a drain of the first film transistor;

a second thin film transistor having a source for inputting a second data voltage and a gate for inputting a second scan voltage;

a second latch having an input connected to a drain of the second film transistor;

a logic control unit having two logic control ends, four voltage input ends and a voltage output end, wherein an output end of the first latch and an output end of the second latch are respectively connected with one of the logic control ends, the four voltage input ends are respectively connected with four different preset voltages, and the logic control unit is used for selecting to output one of the four preset voltages to a pixel electrode via the voltage output end based upon a first data voltage and a second data voltage input by the two logic control ends.

The display driving circuit in the present invention further comprises: a first data line, a first scan line, and a second scan line, wherein the first data line is respectively connected to the sources of the first thin film transistor and the second thin film transistor, the first scan line is connected to the gate of the first thin film transistor, and the second scan line is connected to the gate of the second thin film transistor.

The display driving circuit in the present invention further comprises a first data line, a second data line and a first scan line, wherein the first data line is respectively connected to the source of the first thin film transistor, the second scan line is connected to the source of the second thin film transistor, and the first scan line is connected to the gates of the first thin film transistor and the second thin film transistor.

The present invention provides a pixel structure comprising a pixel capacitance and a display driving circuit, wherein the pixel capacitance includes a common electrode and a pixel electrode;

the display driving circuit includes:

a first thin film transistor having a source for inputting the first data voltage and a gate for inputting a first scan voltage;

a first latch having an input connected to a drain of the first film transistor;

a second thin film transistor having a source for inputting a second data voltage and a gate for inputting a second scan voltage;

a second latch having an input connected to a drain of the second film transistor;

a logic control unit having two logic control ends, four voltage input ends and a voltage output end, wherein an output end of the first latch and an output end of the second latch are respectively connected with one of the logic control ends, the four voltage input ends are respectively connected with four different preset voltages, and the logic control unit is used for selecting to output one of the four preset voltages to a pixel electrode via the voltage output end based upon a first data voltage and a second data voltage input by the two logic control ends, wherein the logic control unit includes a selection module and four third thin film transistors, the selection module has the two logic control ends and four level output ends, input ends of the four third thin film transistors are respectively connected with one of the voltage input ends, output ends of the four third thin film transistors are respectively connected with the voltage output end, and gates of the four third thin film transistors are respectively connected with one of the four level output ends, the selection module selects to switch on one of the four third thin film transistors based upon the first data voltage and the second data voltage, and the other three of the third thin film transistors are switched off.

Compared with the prior art, in the display driving circuit and the pixel structure provided by the present invention, the two latches are used to latch the two data voltage signals. When the image is static, the data lines and the scan lines stop operating, thereby having the beneficial effect of reducing power consumption.

Moreover, since two data voltages are expanded to four data voltages in the logic control unit, and hence each pixel structure has four grayscales.

In order to make the above description of the present invention more clearly understood, preferred embodiments of the present invention will now be described in detail with reference to the accompanying drawings.

DETAILED DESCRIPTION OF THE PREFERRED EMBODIMENTS

The following description of the embodiments with reference to the accompanying drawings is used to illustrate particular embodiments of the present invention. The directional terms referred in the present invention, such as "upper", "lower", "front", "back", "left", "right", "inner", "outer", "side surface", etc. are only directions with regard to the accompanying drawings. Therefore, the directional terms used for describing and illustrating the present invention are not intended to limit the present invention.

In the figures, elements with similar structures are referred to as the same reference numbers.

Figure 1:
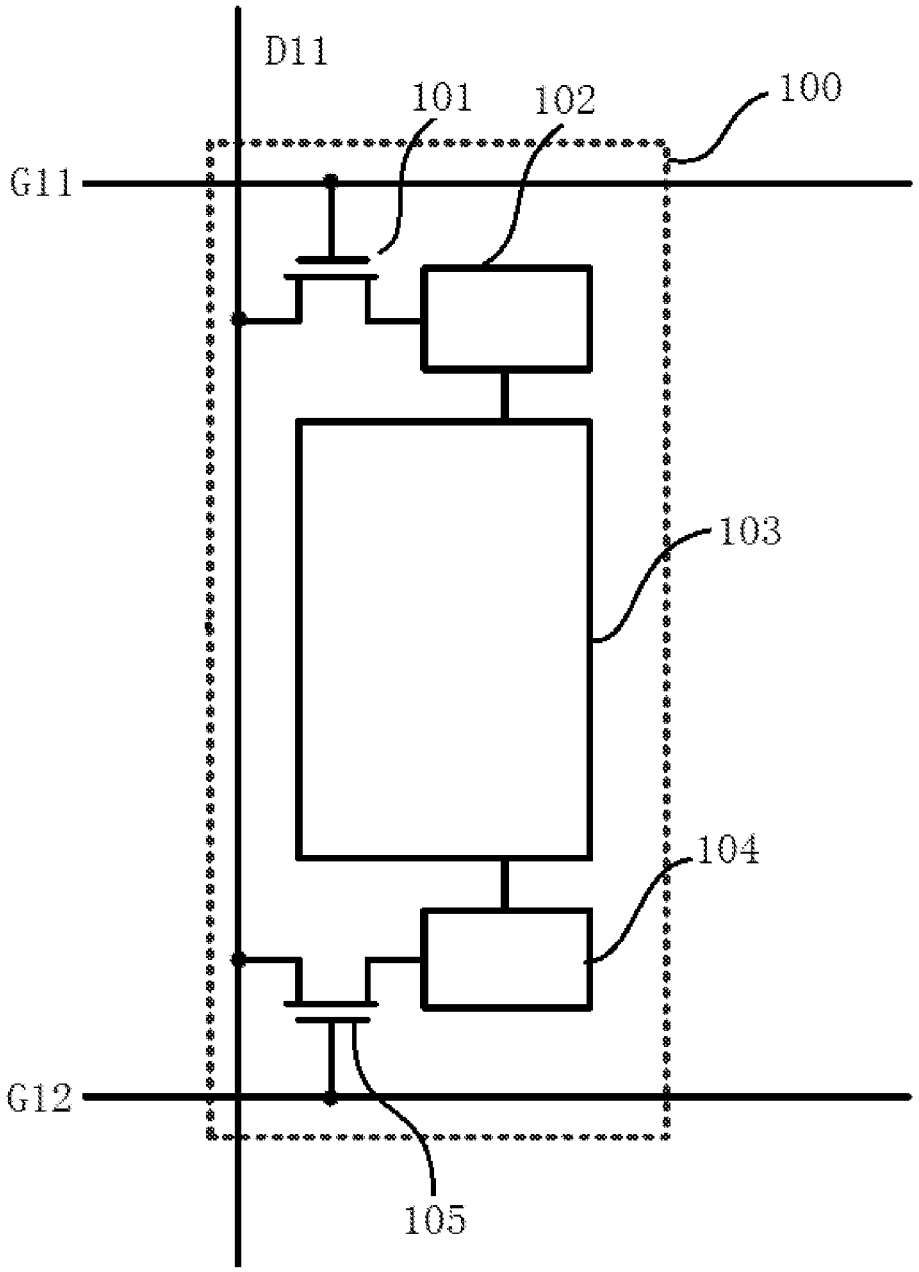
FIG. 1 is a configuration diagram of a pixel structure in a preferred embodiment of the present invention.

Refer to FIG. 1, which is a configuration diagram of a pixel structure in a preferred embodiment of the present invention, which is mainly applied to a backlit LCD. In the present embodiment, the pixel structure includes a first data line D11, a first scan line G11, a second scan line G12, a pixel capacitance, a storage capacitance (not shown), and a display driving circuit 100.

The pixel capacitance includes a common electrode and a pixel electrode. The display driving circuit 100 includes a first thin film transistor 101, a first latch 102, a logic control unit 103, a second latch 104, and a second thin film transistor 105.

A source of the first thin film transistor 101 is connected with the first data line D11 for inputting a first data voltage, and a gate of the first thin film transistor 101 is connected with the first scan line G11 for inputting the first scan voltage. An input end of the first latch 102 is connected with a drain of the first thin film transistor 101. A source of a second thin film transistor 105 is connected with the first data line D11 for inputting a second data voltage, and a gate of the second thin film transistor 105 is connected with the second scan line G12 for inputting a second scan voltage. An input end of the second latch is connected with a drain of the second thin film transistor 105. The logic control unit 103 has two logic control ends, four voltage input ends and a voltage output end. An output end of the first latch 102 and an output end of the second latch 104 are respectively connected with one of the logic control ends. The four voltage input ends are respectively connected with four different preset. voltages. The logic control unit 103 is used for selecting to output one of the four preset voltages to a pixel electrode via the voltage output end based upon a first data voltage and a second data voltage input by the two logic control ends.

Figure 2:
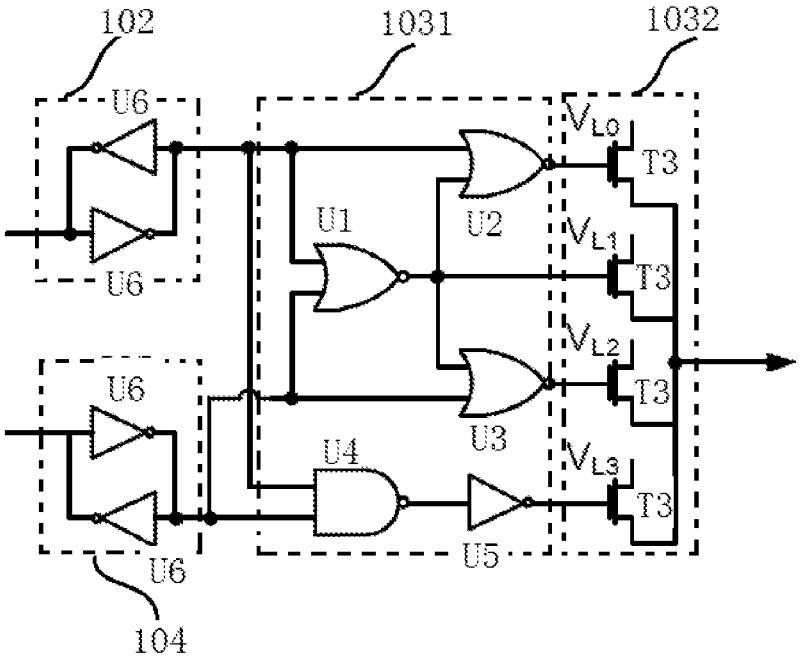
FIG. 2 is a partial circuit configuration diagram of the pixel structure in the embodiment as shown in FIG. 1 of the present invention.
Figure 3:
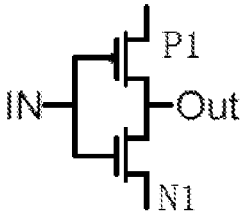
FIG. 3 is a circuit configuration diagram of a second inverter in the embodiment shown in FIG. 1 of the present invention.

Specifically, as shown in FIG. 2, the logic control unit. 103 includes a selection module 1031 and an input module 1032. The input module 1032 includes four third thin film transistors T3. The selection module 1031 has the two logic control ends and four level output ends. Input ends of the four third thin film transistors T3 are respectively connected with the voltage input ends of the logic control unit 103. The four voltage input ends respectively input four different voltages, $V_{L0}$, $V_{L1}$, $V_{L2}$ and $V_{L3}$. Output ends of the four third thin film transistors T3 are respectively connected with the voltage output end. Gates of the four third thin film transistors T3 are respectively connected with one of the four level output ends. The selection module selects to switch on one of the four third thin film transistors T3 based upon the first data voltage and the second data voltage, and the other three of the third thin film transistors T3 are switched off, thereby outputting one of the four different preset voltages, $V_{L0}$, $V_{L1}$, $V_{L2}$ and $V_{L3}$ to the pixel electrode of the pixel capacitance.

The selection module includes a two-input first NOR gate U1, a two-input second NOR gate U2, a two-input third NOR gate U3, a two-input first NAND gate U4 and a two-input first inverter U5. A first input end of the first NOR gate U1, a first input end of the second NOR gate U2 and a first input end of the first NAND gate U4 are respectively connected with an output end of the first latch 102. A second input end of the first NOR gate U1, a first input end of the third NOR gate U3 and a second input end of the first NAND gate U4 are respectively connected with an output end of the second latch 104. A second input end of the second NOR gate U2 and a second input end of the third NOR gate U3 are connected with a output end of the first NOR gate U1. An input end of the first inverter U5 is connected with an output end of the first NAND U4. Output ends of the first NOR gate U1, the second NOR gate U2, the third NOR gate U3, and the first inverter U5 are respectively connected with the gate of the third thin film transistor T3.

The first latch 102 and the second latch 104 each includes two second inverters U6 which are connected end-to-end.

The second inverter U6 includes a first N-channel thin film transistor N1 and a first P-channel thin film transistor P1. Output ends of the first N-channel thin film transistor N1 and the first P-channel thin film transistor P1 are connected at a connection point which is served as an output end of the second inverter U6. Gates of the first N-channel thin film transistor N1 and the first P-channel thin film transistor P1 are connected at a connection point which is served as an input end of the second inverter U6. Input ends of the first N-channel thin film transistor N1 and the first P-channel thin film transistor P1 are respectively connected with a first preset voltage and a second preset voltage. The first preset voltage is in a low level, and the second preset voltage is in a high level.

Figure 4:
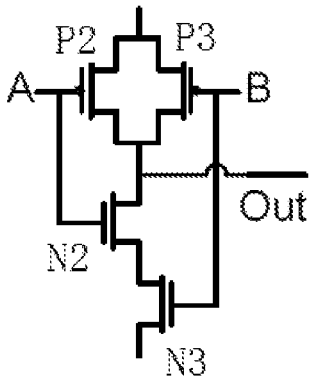
FIG. 4 is a circuit configuration diagram of a first NOR gate in the embodiment shown in FIG. 1 of the present invention.

As shown in FIG. 4, the first NAND gate U4 includes a second N-channel thin film transistor N2, a third N-channel thin film transistor N3, a second P-channel thin film transistor P2, and a third P-channel thin film transistor P3. Input ends of the second P-channel thin film transistor P2 and the third P-channel thin film transistor P3 are connected, and a first preset voltage is connected to a connection point. Output ends of the second N-channel thin film transistor N2, the second P-channel thin film transistor P2, and the third P-channel thin film transistor P3 are connected at a connection point which is served as an output end of the first NAND gate U4. A gate of the second P-channel thin film transistor P2 and a gate of the second N-channel thin film transistor N2 are connected at a connection point which is served as the first input end of the first NAND gate U4. A gate of the third P-channel thin film transistor P3 and a gate of the third N-channel thin film transistor N3 are connected at a connection point which is served as the second input end of the first NAND gate U4. An input end of the third N-channel thin film transistor N3 is connected with a first preset voltage.

Figure 5:
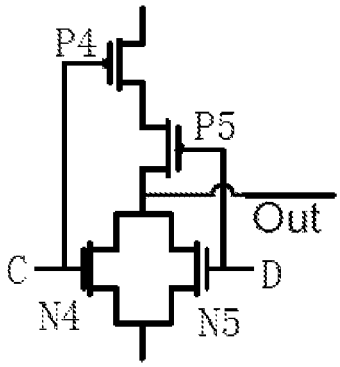
FIG. 5 is a circuit configuration diagram of a first NAND gate in the embodiment shown in FIG. 1 of the present invention.

As shown in FIG. 5, the first NOR gate, the second NOR gate, the third NOR gate and the fourth NOR gate have the same structure, and each NOR gate includes a fourth P-channel thin film transistor P4, a fifth P-channel thin film transistor P5, a fourth N-channel thin film transistor N4, and a fifth N-channel thin film transistor N5.

An input end of the fourth P-channel thin film transistor P4 is connected with the first preset voltage.

An output end of the fourth P-channel thin film transistor P4 is connected with an input end of the fifth P-channel thin film transistor P5.

Output ends of the fifth P-channel thin film transistor P5, the fourth N-channel thin film transistor N4, and the fifth N-channel thin film transistor N5 are connected at a connection point which is served as an output end of the NOR gate.

An input end of the fourth P-channel thin film transistor P4 is connected with the first preset voltage.

A gate of the forth P-channel thin film transistor P4 and a gate of the forth N-channel thin film transistor N4 are connected at a connection point which is served as a first input end of the NOR gate.

A gate of the fifth N-channel thin film transistor N5 and a gate of the fifth P-channel thin film transistor P5 are connected at a connection point which is served as a second input of the NOR gat.

Output ends of the fourth N-channel thin film transistor N4 and the fifth N-channel thin film transistor N5 at a connection point which is connected with a second preset voltage.

Working principle: By the logic control unit 103 controlling to output one of the four grayscale voltages $V_{L0}$, $V_{L1}$, $V_{L2}$, and $V_{L3}$ to the pixel electrode, each sub-pixel is capable of displaying four grayscales, so that for a panel in which each pixel is composed of three RGB sub-pixels, 64 colors can be displayed. Before inputting into the logic control unit 10, the data voltage of each sub-pixel goes through a latch (the first latch or the second latch), and the two signals controlling the output of the grayscale voltages are stored in the pixel. Hence, even if the pixel has not been refreshed for a long time, the pixel is still capable of displaying the previously stored grayscale, which is equivalent to the pixel having a grayscale storage function. When the panel displays a static image, that is, displaying the same image for a long time, the grayscale signal enters each pixel only once, and then there is no need to refresh the panel.

As can be seen from the above, in the display driving circuit and the pixel structure provided by the invention, two latches are used for latching the two data signals. When the image is static, no further scanning is required, and the data lines and the scan lines stop working, thereby having a beneficial effect of reducing power consumption.

Moreover, since the logic control unit expands from the two data voltages to the four data voltages, each pixel structure has four grayscales.

Figure 6:
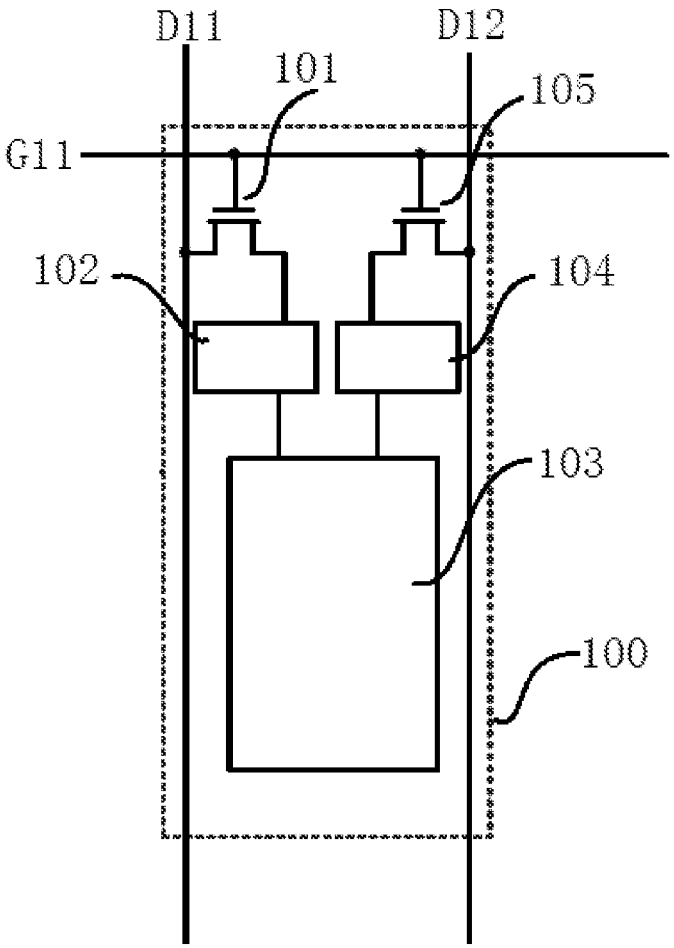
FIG. 6 is a configuration diagram of a pixel structure in another preferred embodiment of the present invention.

As shown in FIG. 6, it is understood that in the second embodiment provided by the present invention, the pixel structure includes a first data line D11, a second data line D12, a first scan line G11, a pixel capacitance, a storage capacitance (not shown) and the display driving circuit 100. The first data line D11 is connected with a source of a first thin film transistor 101, and the second data line D12 is connected with a source of a second thin film transistor 105. The first scan line G11 is connected with gates of the first thin film transistor 101 and the second thin film transistor 105.

The display driving circuit 100 includes a first thin film transistor 101, the first latch 102, a logic control unit 103, a second latch 104, and the second thin film transistor 105.

A source of the first thin film transistor 101 is connected with the first data line D11 for inputting a first data voltage, and a gate of the first thin film transistor 101 is connected. with the first scan line G11 for inputting the first scan voltage. An input end of the first latch 102 is connected with a drain of the first thin film transistor 101. A source of a second thin film transistor 105 is connected with the first data line D11 for inputting a second data voltage, and a gate of the second thin film transistor 105 is connected with the second scan line G12 for inputting a second scan voltage. An input end of the second latch is connected with a drain of the second thin film transistor 105. The logic control unit 103 has two logic control ends, four voltage input ends and a voltage output end. An output end of the first latch 102 and an output end of the second latch 104 are respectively connected with one of the logic control ends. The four voltage input ends are respectively connected with four different preset voltages. The logic control unit 103 is used for selecting to output one of the four preset voltages to a pixel electrode via the voltage output end based upon a first data voltage and a second data voltage input by the two logic control ends. Sine the same data line is connected, the first data voltage is the same as the second data voltage.

Working principle: By the logic control unit 103 controlling to output one of the four grayscale voltages $V_{L0}$, $V_{L1}$, $V_{L2}$, and $V_{L3}$ to the pixel electrode, each sub-pixel is capable of displaying four grayscales, so that for a panel in which each pixel is composed of three RGB sub-pixels, 64 colors can be displayed. Before inputting into the logic control unit 10, the data voltage of each sub-pixel goes through a latch (the first latch or the second latch), and the two signals controlling the output of the grayscale voltages are stored in the pixel. Hence, even if the pixel has not been refreshed for a long time, the pixel is still capable of displaying the previously stored grayscale, which is equivalent to the pixel having a grayscale storage function. When the panel displays a static image, that is, displaying the same image for a long time, the grayscale signal enters each pixel only once, and then there is no need to refresh the panel.

As can be seen from the above, in the display driving circuit and the pixel structure provided by the invention, two latches are used for latching the two data signals. When the image is static, no further scanning is required, and the data lines and the scan lines stop working, thereby having a beneficial effect of reducing power consumption;

Moreover, since the logic control unit expands from the two data voltages to the four data voltages, each pixel structure has four grayscales.

In summary, although the preferable embodiments of the present invention have been disclosed above, the embodiments are not intended to limit the present invention. A person of ordinary skill in the art, without departing from the spirit and scope of the present invention, can make various modifications and variations. Therefore, the scope of the invention is defined in the claims.

What is claimed is:

1. A display driving circuit, comprising:

a first latch for latching a first data voltage;

a second latch for latching a second data voltage;

a logic control unit having two logic control ends, four voltage input ends and a voltage output end, wherein an output end of the first latch and an output end of the second latch are respectively connected with one of the logic control ends, the four voltage input ends are respectively connected with four different preset voltages, and the logic control unit is used for selecting to output one of the four preset voltages to a pixel electrode via the voltage output end based upon a first data voltage and a second data voltage input by the two logic control ends.

2. The display driving circuit as claimed in claim 1, further comprising:

a first thin film transistor having a source for inputting the first data voltage, a gate for inputting a first scan voltage and a drain connected to an input end of the first latch; and a second thin film transistor having a source for inputting a second data voltage, a gate for inputting a second scan voltage and a drain connected to an input of the second latch.

3. The display drive circuit as claimed in claim 2, wherein the logic control unit includes a selection module and four third thin film transistors, the selection module has the two logic control ends and four level output ends, input ends of the four third thin film transistors are respectively connected with one of the voltage input ends, output ends of the four third thin film transistors are respectively connected with the voltage output end, and (Yates of the four third thin film transistors are respectively connected with one of the four level output ends, the selection module selects to switch on one of the four third thin film transistors based upon the first data voltage and the second data voltage, and the other three of the third thin film transistors are switched off.

4. The display driving circuit as claimed in claim 3, wherein the selection module includes a two-input first NOR gate, a two-input second NOR gate, a two-input third NOR gate, a two-input first NAND gate and a two-input first inverter;

a first input end of the first NOR gate, a first input end of the second NOR gate and a first input end of the first NAND gate are respectively connected with an output end of the first latch;

a second input end of the first NOR gate, a first input end of the third NOR gate and a second input end of the first NAND gate are respectively connected with an output end of the second latch;

a second input end of the second NOR gate and a second input end of the third NOR gate are connected with a output end of the first NOR gate;

an input end of the first inverter is connected with an output end of the first NAND; and output ends of the first NOR gate, the second NOR gate, the third NOR gate and the first inverter are respectively connected with the gate of the third thin film transistor.

5. The display driving circuit as claimed in claim 4, wherein the first NAND gate includes a second N-channel thin film transistor, a third N-channel thin film transistor, a second P-channel thin film transistor, and a third P-channel thin film transistor;

input ends of the second P-channel thin film transistor and the third P-channel thin film transistor are connected, and a first preset voltage is connected to a connection point;

output ends of the second N-channel thin film transistor, the second P-channel thin film transistor, and the third P-channel thin film transistor are connected at a connection point which is served as an output end of the first NAND gate;

a gate of the second P-channel thin film transistor and a gate of the second N-channel thin film transistor are connected at a connection point which is served as the first input end of the first NAND gate;

a gate of the third P-channel thin film transistor and a gate of the third N-channel thin film transistor are connected at a connection point which is served as the second input end of the first NAND gate; and an input end of the third N-channel thin film transistor is connected with a second preset voltage.

6. The display driving circuit as claimed in claim 2, wherein the first latch and the second latch each includes two second inverters which are connected end-to-end.

7. The display driving circuit as claimed in claim 6, wherein the second inverter includes a first N-channel thin film transistor and a first P-channel thin film transistor, output ends of the first N-channel thin film transistor and the first P-channel thin film transistor are connected at a connection point which is served as an output end of the second inverter, gates of the first N-channel thin film transistor and the first P-channel thin film transistor are connected at a connection point which is served as an input end of the second inverter; and input ends of the first N-channel thin film transistor and the first P-channel thin film transistor are respectively connected with a first preset voltage and a second preset voltage.

8. The display driving circuit as claimed in claim 1, wherein the first latch and the second latch each includes two second inverters which are connected end-to-end.

9. The display driving circuit as claimed in claim 8, wherein the second inverter includes a first N-channel thin film transistor and a first P-channel thin film transistor, output ends of the first N-channel thin film transistor and the first P-channel thin film transistor are connected at a connection point which is served as an output end of the second inverter, gates of the first N-channel thin film transistor and the first P-channel thin film transistor are connected at a connection point which is served as an input end of the second inverter; and input ends of the first N-channel thin film transistor and the first P-channel thin film transistor are respectively connected with a first preset voltage and a second preset voltage.

10. A pixel structure, comprising:

a pixel capacitance and a display driving circuit, wherein the pixel capacitance includes a common electrode and a pixel electrode;

the display driving circuit includes:

a first thin film transistor having a source for inputting the first data voltage and a gate for inputting a first scan voltage;

a first latch having an input connected to a drain of the first film transistor;

a second thin film transistor having a source for inputting a second data voltage and a gate for inputting a second scan voltage;

a second latch having an input connected to a drain of the second film transistor;

a logic control unit having two logic control ends, four voltage input ends and a voltage output end, wherein an output end of the first latch and an output end of the second latch are respectively connected with one of the logic control ends, the four voltage input ends are respectively are connected with four different preset voltages, and the logic control unit is used for selecting to output one of the four preset voltages to a pixel electrode via the voltage output end based upon a first data voltage and a second data voltage input by the two logic control ends.

11. The pixel structure as claimed in claim 10, further comprising:

a first data line, a first scan line, and a second scan line, wherein the first data line is respectively connected to the sources of the first thin film transistor and the second thin film transistor, the first scan line is connected to the gate of the first thin film transistor, and the second scan line is connected to the gate of the second thin film transistor.

12. The pixel structure as claimed in claim 10, further comprising:

a first data line, a second data line and a first scan line, wherein the first data line is respectively connected to the source of the first thin film transistor, the second scan line is connected to the source of the second thin film transistor, and the first scan line is connected to the gates of the first thin film transistor and the second thin film transistor.

13. A pixel structure comprising:

a pixel capacitance and a display driving circuit, wherein the pixel capacitance includes a common electrode and a pixel electrode;

the display driving circuit includes:

a first thin film transistor having a source for inputting the first data voltage and a gate for inputting a first scan voltage;

a first latch having an input connected to a drain of the first film transistor;

a second thin film transistor having a source for inputting a second data voltage and a gate for inputting a second scan voltage;

a second latch having an input connected to a drain of the second film transistor;

a logic control unit having two logic control ends, four voltage input ends and a voltage output end, wherein an output end of the first latch and an output end of the second latch are respectively connected with one of the logic control ends, the four voltage input ends are respectively connected with four different preset voltages, and the logic control unit is used for selecting to output one of the four preset voltages to a pixel electrode via the voltage output end based upon a first data voltage and a second data voltage input by the two logic control ends, wherein the logic control unit includes a selection module and four third thin film transistors, the selection module has the two logic control ends and four level output ends, input ends of the four third thin film transistors are respectively connected with one of the voltage input ends, output ends of the four third thin film transistors are respectively connected with the voltage output end, and gates of the four third thin film transistors are respectively connected with one of the four level output ends, the selection module selects to switch on one of the four third thin film transistors based upon the first data voltage and the second data voltage, and the other three of the third thin film transistors are switched off.

* * * * *